US012760625B2

(12) United States Patent
Galvão et al.

(10) Patent No.: US 12,760,625 B2
(45) Date of Patent: Oct. 13, 2026

(54) SUBSEA MANIFOLD WITH RETRIEVABLE MODULES AND RESIDENT VALVE ARRANGEMENT

(71) Applicant: TECHNIPFMC DO BRASIL LTDA, Rio de Janeiro (BR)

(72) Inventors: Rafael Galvão, Rio de Janeiro (BR); Andre Faisca, Rio de Janeiro (BR)

(73) Assignee: TECHNIPFMC DO BRASIL LTDA, Rio de Janeiro (BR)

( * ) Notice: Subject to any disclaimer, the term of this patent is extended or adjusted under 35 U.S.C. 154(b) by 0 days.

(21) Appl. No.: 19/054,522

(22) Filed: Feb. 14, 2025

(65) Prior Publication Data

US 2026/0243151 A1 Aug. 20, 2026

(51) Int. Cl.

| | |
|---|---|
| ***E21B 43/017*** | (2006.01) |
| ***E21B 41/00*** | (2006.01) |
| ***E21B 43/12*** | (2006.01) |
| ***E21B 47/10*** | (2012.01) |

(52) U.S. Cl.
CPC ..... *E21B 43/017* (2013.01); *E21B 41/0007* (2013.01); *E21B 43/122* (2013.01); *E21B 47/10* (2013.01)

(58) Field of Classification Search
CPC .. E21B 43/017; E21B 41/0007; E21B 43/122; E21B 47/10
See application file for complete search history.

(56) References Cited

U.S. PATENT DOCUMENTS 5,025,865 A 6/1991 Caldwell et al.

FOREIGN PATENT DOCUMENTS

| | | | | |
|---|---|---|---|---|
| BR | 112017005539 A2 | | 12/2017 | |
| GB | 2285647 A | * | 7/1995 | ..... E21B 43/017 |
| WO | 2020120964 A1 | | 6/2020 | |
| WO | 2021209754 A1 | | 10/2021 | |
| WO | WO-2026015956 A1 | * | 1/2026 | |
| WO | WO-2026015958 A1 | * | 1/2026 | ..... E21B 43/017 |

OTHER PUBLICATIONS

PCT Patent Application PCT/BR25/50576 International Search Report and Written Opinion of the International Searching Authority issued Mar. 30, 2026.

* cited by examiner

*Primary Examiner* — James G Sayre
(74) *Attorney, Agent, or Firm* — Erise IP, P.A.

(57) ABSTRACT

Systems, methods, assemblies, and devices for providing a subsea module with a resident valve arrangement and one or more retrievable modules. One or more valves of the resident valve arrangement may be adjusted to provide a cleaning fluid path to clean an individual retrievable module without cleaning the entire manifold or other retrievable modules.

13 Claims, 5 Drawing Sheets

SUBSEA MANIFOLD WITH RETRIEVABLE MODULES AND RESIDENT VALVE ARRANGEMENT

BACKGROUND

1. Field

Embodiments of the present disclosure relate to subsea operations. More specifically, embodiments of the present disclosure relate to subsea hydraulic fracturing structures.

2. Related Art

Subsea manifold systems typically include four or more header lines. For example, a typical hydraulic fracturing manifold for subsea fracking operations includes four or more header lines, such as a gas lift line, a test gas lift line, a production line, and a test production line. Here, the test gas lift line may be used to estimate a production level based on an amount of gas lift fluid in the test gas lift line. However, the number of header lines complicates the overall manifold structure and places additional strain on a riser connection to surface equipment.

In some instances, modular manifold blocks may be removably coupled to the subsea manifold. However, removal of the modular manifold blocks typically involves cleaning the entire manifold assembly prior to removal.

SUMMARY

Embodiments of the present disclosure solve the above-mentioned problems by providing a subsea manifold system, resident valve arrangement, and retrievable modules, e.g., modules that may be selectively and removably coupled and replaced. The resident valve arrangement may be permanently disposed in a portion of the subsea manifold and may be configured to provide individual cleaning of respective retrievable modules prior to removal.

In some aspects, the techniques described herein relate to a resident valve arrangement disposed in a subsea manifold. The resident valve arrangement includes a plurality of production header selection valves fluidly coupled to a production line of the subsea manifold, each production header selection valve of the plurality of production header selection valves corresponding to a respective retrievable module of a plurality of retrievable modules removably coupled to the subsea manifold. The resident valve arrangement further includes a plurality of gas lift header selection valves fluidly coupled to a gas lift line of the subsea manifold, each gas lift header selection valve corresponding to a respective retrievable module of the plurality of retrievable modules removably coupled to the subsea manifold. The resident valve arrangement further includes a plurality of test production header selection valves fluidly coupled to a test production line of the subsea manifold, each test production header selection valve of the plurality of test production header selection valves corresponding to a respective production header selection valve of the plurality of production header selection valves or a respective gas lift header selection valve of the plurality of gas lift header selection valves.

In some aspects, the techniques described herein relate to a subsea system including a subsea manifold. The subsea manifold can include: a production header line; a gas lift header line; a test production header line; and a resident valve arrangement disposed in a permanent portion of the subsea manifold. The resident valve arrangement can further include a plurality of header selection valves; and a plurality of retrievable modules removably disposed in the subsea manifold. Each retrievable module of the plurality of retrievable modules can include: one or more flow meters; one or more flow chokes; and a plurality of fluid connections to a respective plurality of flow lines of the subsea manifold, the plurality of fluid connections fluidly coupled to a respective plurality of header selection valves that are resident to a permanent portion of the subsea manifold.

In some aspects, the techniques described herein relate to a retrievable module for a subsea manifold. The retrievable module includes: a production line fluid connection fluidly coupled to a manifold-resident production header selection valve of the subsea manifold associated with a production line of the subsea manifold; a gas lift line fluid connection fluidly coupled to a manifold-resident gas lift header selection valve of the subsea manifold associated with a gas lift line of the subsea manifold; a production flow meter operable to measure a flow rate associated with the production line; a gas lift flow meter operable to measure a flow rate associated with the gas lift line; a production flow choke associated with the production line; and a gas lift flow choke associated with the gas lift flow choke. The retrievable module is removably coupled to the subsea manifold.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, where:

Figure 1A:
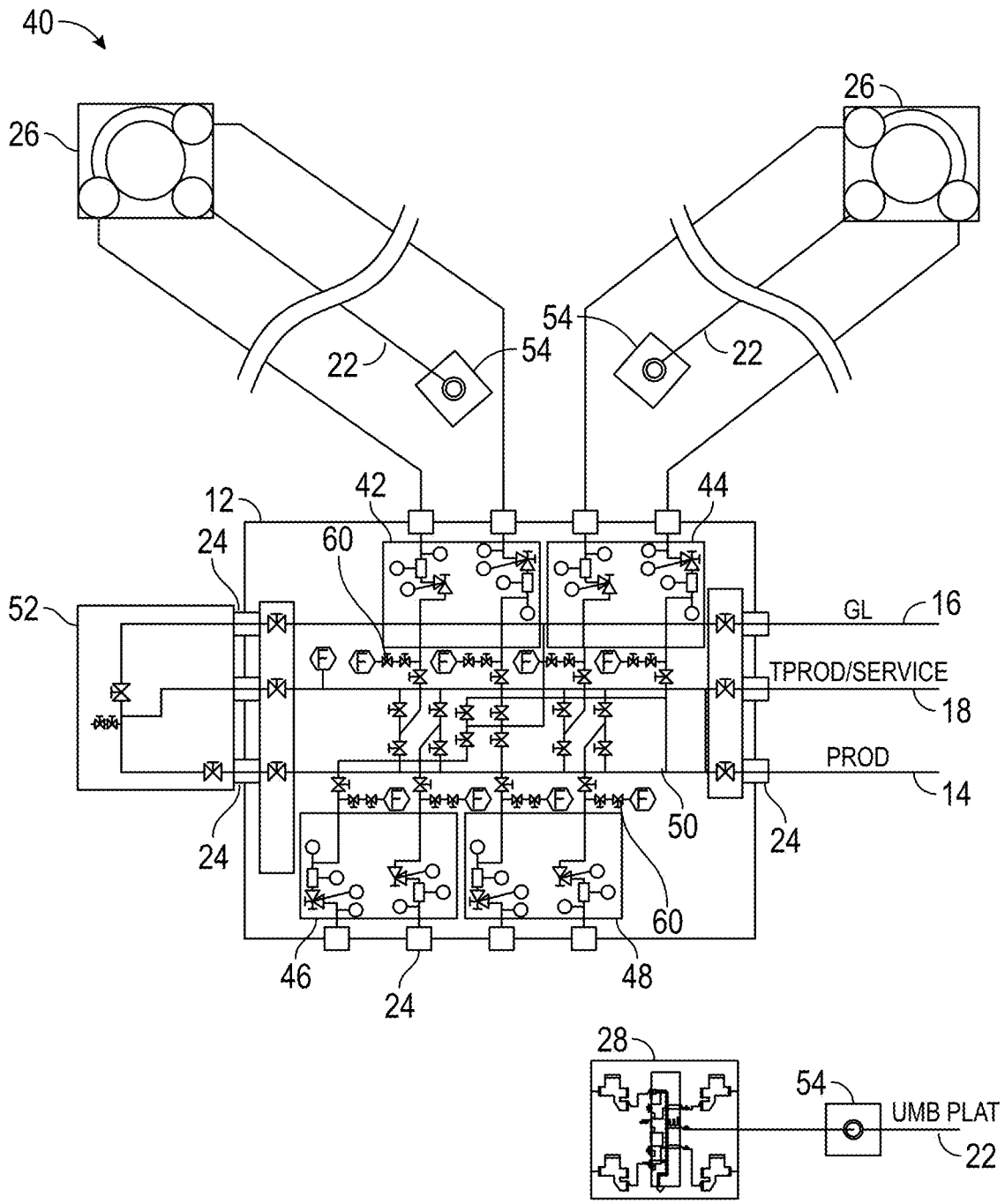
FIGS. 1A and 1B illustrate an exemplary subsea manifold system with retrievable modules.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. Therefore, the following detailed description is not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the technology can include a variety of combinations and/or integrations of the embodiments described herein.

Embodiments of the present disclosure relate to subsea manifold systems with one or more retrievable modules and a resident valve arrangement allowing individual cleaning and maintenance of the retrievable modules.

Prior art systems relate to subsea manifold systems, such as subsea manifold systems disposed in a subsea environment. As an example, the subsea manifold system may be used to route fluids and gases between a plurality of tree structures and a floating production, storage, and offloading vessel ("FPSO"). The subsea manifold system may comprise a manifold fluidly coupled to a plurality of fluid lines. For example, each of a production line, a gas lift line, a test production line, a test gas lift line, and an umbilical line may be coupled to the manifold.

In prior art manifold systems, a plurality of modules including one or more sets of module-resident valves disposed therein may be coupled to the manifold. The module-resident valves may be header selection valves used to select a header of the manifold through which fluid is routed.

During operation, a production value of the subsea manifold system may be calculated by subtracting a value associated with the test gas lift line from a value associated with the test production line. The values may include flow values, pressure values, or volume values directly. As such, in prior art systems, the test gas lift line may be relied upon to estimate a production value.

Prior art systems typically utilize full manifold assembly cleaning techniques for routine cleaning and maintenance, or prior to removal of each respective module. For example, prior to removing one of the modules, prior art techniques involve pumping a cleaning fluid through the entire manifold or at least a substantial portion of the manifold and the modules. An exemplary cleaning process includes pumping a cleaning fluid through one of the gas lift line or the test gas lift line and through two or more of the modules. As an example, prior to removing the first module, a cleaning fluid may be pumped through the gas lift line, through the manifold, through each of the first module and the second module, and back up to the FPSO through the test production line.

Embodiments of the present disclosure contemplate a manifold-resident valve arrangement disposed within a permanent portion of the manifold instead of within the individual modules. Further, embodiments are contemplated in which the test gas lift line may not be included. In such embodiments, the production volume may be determined based on one or more flow meters disposed within retrievable modules, as described in further detail below. Further still, embodiments of the present disclosure contemplate a selective and distinct process for cleaning individual modules, as opposed to the full manifold cleaning process of the prior art described above.

FIG. 1A illustrates an exemplary subsea manifold system 40 relating to some embodiments of the present disclosure. The subsea manifold system 40 comprises a manifold 12, as shown. In some embodiments, the manifold 12 comprises a manifold block, which may be a rigid structure having a plurality of bore holes disposed therethrough. Alternatively, in some embodiments, flexible manifold structures are contemplated.

The manifold 12 may be fluidly coupled to a plurality of fluid lines. For example, each of a production line 14 ("PROD"), a gas lift line 16 ("GL"), a test production line 18 ("TPROD"), and an umbilical line 22 ("UMB PLAT") may be coupled to the manifold 12. The lines may be coupled to the manifold 12 via a respective plurality of hubs 24. As shown, the umbilical line 22 includes termination hubs 24 mounted directly to the manifold structure. Each of the lines 14, 16, 18, and 22 may be routed from the manifold 12 to the FPSO or another structure or vessel. Additionally, the lines may also be coupled to one or more tree structures. For example, the lines 14, 16, 18, and 22 may include any number of sections of flexible flow lines. Alternatively, or additionally, the lines may include a combination of both flexible and rigid flow lines.

The production line 14 may be used to route production fluid from a well formation up through risers to the FPSO. The gas lift line 16 may be used to inject a gas lift fluid into the well formation. For example, the gas lift fluid may include any of methane, butane, or another hydrocarbon substance injected into the well to stimulate and increase production. Pumping the gas lift fluid into the well formation increases the pressure within the well such that additional production fluid is pushed out of the well formation.

The manifold 12 may also be fluidly coupled to one or more trees 26. The at least one tree 26, also referred to as a "Christmas" tree, tree structure, or tree assembly, may be coupled to a subsea production well, such that a production fluid may be provided to the manifold 12 from each tree 26. Each of the modules may be coupled to a respective tree 26, as shown.

The subsea manifold system 40 further includes a control module 28. The control module 28 is coupled to the manifold 12 and may be configured to hydraulically and/or electrically control portions of the subsea manifold system 40. For example, the control module 28 may be coupled to a plurality of hydraulic lines such that operation of the components of the subsea manifold system 40 may be controlled hydraulically. In some embodiments, the control module 28 includes a combination of electrical and hydraulically actuated components. For example, the control module 28 may communicate electronically with surface equipment and then transmit control signals hydraulically via one or more electrically actuated hydraulic components such as one or more hydraulic pumps driven by electric motors.

The subsea manifold system 40 may comprise a three-line configuration. For example, the test gas lift line may not be included to simplify the system structure, as will be described in further detail below. Thus, in some embodiments, the subsea manifold system 40 comprises the manifold 12, the production line 14, the gas lift line 16, the test production line 18, the hubs 24, the trees 26, and the control module 28.

The subsea manifold system 40 includes one or more retrievable modules, such as a first retrievable module 42, a second retrievable module 44, a third retrievable module 46, and a fourth retrievable module 48, as shown. In some embodiments, each retrievable module is associated with a respective tree 26. However, it should be understood that only a portion of the plurality of retrievable modules may be active at a given time. For example, the first retrievable module 42 may be coupled to a first tree and the second retrievable module 44 may be coupled to a second tree, while the third retrievable module 46 and the fourth retrievable module 48 are not actively coupled to a tree 26. Alternatively, or additionally, all modules may be active, or a different combination of the modules may be active.

In contrast to the prior art subsea manifold systems, the retrievable modules of the subsea manifold system 40 illustrated in FIG. 1A do not include module-resident valves disposed therein. Instead, the header selection valves of the subsea manifold system 40 are resident to (i.e., reside on) a permanent portion of the manifold 12, e.g., a portion of the manifold that does not include the plurality of retrievable modules and is not selectively removable from the manifold. For example, the header selection valves may be included within a valve arrangement 50 (which is an exemplary permanent portion of the manifold) disposed permanently on or within the manifold 12. In some embodiments, the valve arrangement 50 is disposed on or in a permanent portion of the manifold 12 between the test production line 18 and the production line 14, as shown; however, the permanent valve arrangement 50 may be disposed at other locations on the manifold 12. The valve arrangement 50 comprises a plurality of valves such as multiple sets of header selection valves for controlling fluid flow from each of the lines 14, 16, and 18. The absence of the header selection valves within the retrievable modules decreases the overall weight of the retrievable modules, which facilitates easier removal and replacement.

The valve arrangement 50 may include a respective set of valves (illustrated in more detail in FIG. 2) for each connection of the flow lines to the modules. For example, a first set of valves may be disposed in a flow path between the production line 14 and the first retrievable module 42 and a second set of valves may be disposed in a flow path between the gas lift line 16 and the first retrievable module 42. In some embodiments, the valve arrangement 50 includes varying combinations of serially and parallel-oriented valves. The valve arrangement 50, as shown in FIG. 1A, includes three portions comprising a first and second set of valves coupled to the production line 14 and a third set of valves coupled to the gas lift line 16, as described in further detail with respect to FIG. 2.

The subsea manifold system 40 of FIG. 1A further includes a pigging module 52 coupled to the manifold 12. The pigging module 52 may comprise a rigid manifold structure coupled directly to hubs 24 of the manifold 12. Alternatively, in some embodiments, the pigging module 52 may be coupled via flow lines such as any combination of the flexible or rigid flow lines described herein. The pigging module 52 may be used for a pigging operation of the subsea manifold system 40. As an example, a pigging operation may include launching a pigging device, also referred to as a "pig" into a flowline bore of one or more of the lines, such as, any of the production line 14, the gas lift line 16, and the test production line 18. The pigging operation may be characterized as a maintenance operation carried out without stopping flow of the subsea manifold system 40. The pigging device may include any of gauges, sensors, scrapers, cleaning components, and other suitable maintenance devices. In some embodiments, one or more of the lines are 'piggable.' That is, one or more of the lines have a diameter suitable to receive a pigging device therethrough.

The pigging module 52 may selectively route paths of the flow lines 14, 16, and 18. As such, a pigging maintenance operation may include opening one or more valves of the pigging module 52 to connect the flow paths of the test production line 18 and the production line 14. The pigging device (described in the prior paragraph) may be launched through the test production line 18 and travel back through the production line 14, for example, to clean the respective lines. The pigging device may be launched at the surface from the FPSO connection and may be routed back to the surface through another suitable flow line such as the production line 14. However, it should be understood that, in some embodiments, the pigging device may be routed through other sections of the subsea manifold system 40 and may be launched through another suitable flow line.

In some embodiments, the pigging module 52 is also retrievable. For example, the pigging module 52 may be removably coupled to the manifold 12 such that the pigging module 52 may be removed and replaced.

The subsea manifold system 40 further includes one or more separate mounting structures 54 configured to receive terminations of the umbilical line 22 such that the terminations are not directly mounted to the structure of the manifold 12. Instead, the terminations of the umbilical line 22 are disposed on the mounting structures 54, which are separate from the manifold 12, as shown. Separate termination points reduce the number of structures and components on the manifold 12 and therefore alleviates crowding of the hubs 24 and lines of the subsea manifold system 40. Further, in some embodiments, the umbilical line 22 may not be directly coupled to a hub 24 of the manifold 12 and is, instead, coupled to the control module 28, as shown. Further still, embodiments are contemplated in which the control module 28 is structurally separate from the manifold 12, as shown. Alternatively, or additionally, in some embodiments, the control module 28 may be coupled to or included on a portion of the manifold 12.

The exemplary subsea manifold system 40, as shown in FIG. 1A, also includes one or more chemical injection valves 60, as will be described in further detail below with respect to FIG. 2. The chemical injection valves 60 may be disposed within the manifold 12, as shown in FIG. 1A. Alternatively, in some embodiments, the chemical injection valves 60 may be disposed within the respective retrievable modules 42, 44, 46, and 48, as shown in FIG. 1B.

Figure 1B:
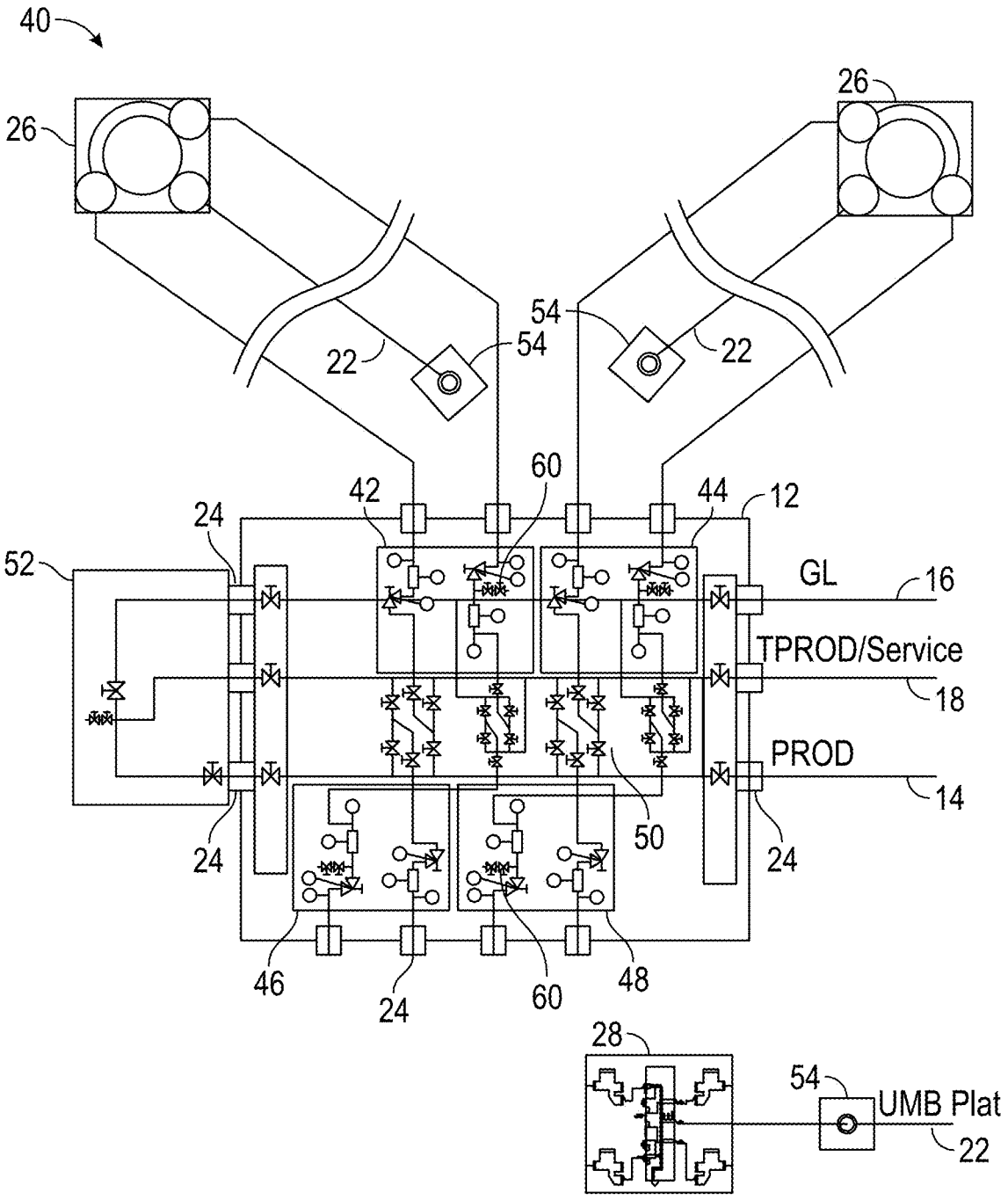

FIG. 1B illustrates an exemplary subsea manifold system 40 relating to some embodiments of the present disclosure. The subsea manifold system 40 includes many common structures as described above with respect to FIG. 1A. However, the valve arrangement 50 may include a different configuration of valves compared to that shown in FIG. 1A. For example, the valve arrangement 50 may include a plurality of header selection valves with a first portion of valves coupled to the production line 14, a second portion of valves coupled to the gas lift line 16, and a third portion of valves coupled to the test production line 18, as will be described in further detail below with respect to FIG. 2, which shows enlarged views of components of FIG. 1B for enhanced visibility. In some embodiments, the chemical injection valves 60 are disposed within each respective retrievable module 42, 44, 46, and 48, as shown. Additional configurations of the valve arrangement 50 not explicitly described herein are also contemplated.

Figure 2:
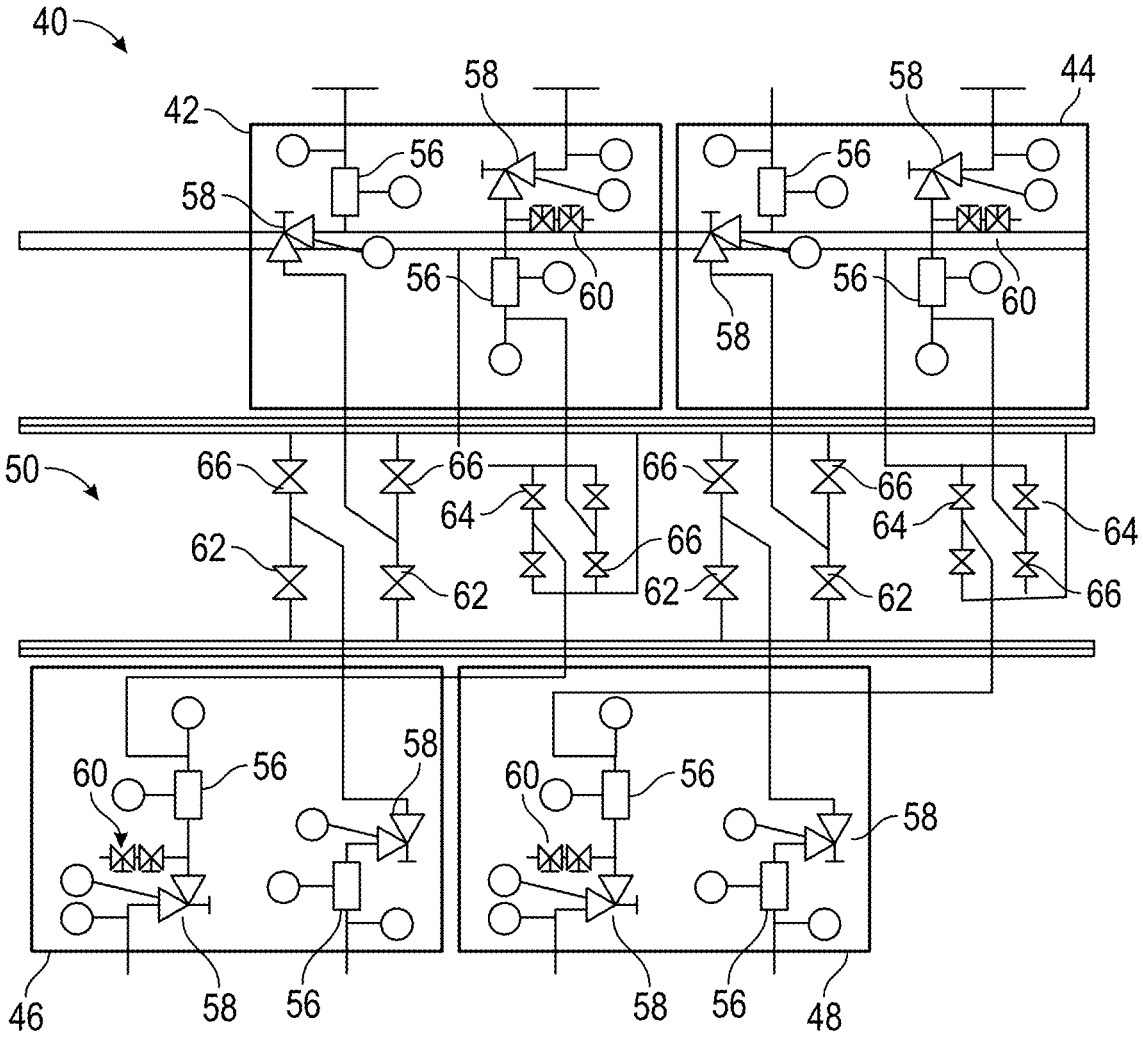
FIG. 2 illustrates an exemplary module configuration of a subsea manifold system.

FIG. 2 illustrates an exemplary portion of the subsea manifold system 40 relating to some embodiments of the present disclosure. The first retrievable module 42, second retrievable module 44, third retrievable module 46, and fourth retrievable module 48 are depicted along with the valve arrangement 50 such that the internal components and subcomponents of the modules are enlarged and more visible as compared to FIG. 1A.

In some embodiments where the valve arrangement 50 is permanently disposed on the manifold 12, such as discussed for FIG. 1A, each retrievable module includes one or more flow meters 56 configured to measure a flow rate through a respective portion of the module. For example, in some embodiments, each module comprises a first flow meter configured to measure a flow rate associated with the production line 14 and a second flow meter configured to measure a flow rate associated with the gas lift line 16. Accordingly, the amount of production can be determined based on data from the flow meters instead of by using the test gas lift line described above. As such, the test gas lift line may be absent, which simplifies the overall design, reduces the number of headers, and reduces strain on risers of the FPSO.

In some embodiments, the retrievable modules comprise one or more flow chokes 58. For example, a first flow choke may be configured to adjust a flow associated with the production line 14, and a second flow choke may be configured to adjust a flow associated with the gas lift line 16 within the respective module.

In some embodiments, the retrievable modules comprise one or more chemical injection valves 60, as shown. The chemical injection valves 60 may be used, for example, to inject chemical substances into the flow from the gas lift line 16.

The valve arrangement 50 includes a plurality of resident header selection valves, as discussed above. In some embodiments, the valve arrangement 50 includes one or more production header selection valves 62 associated with the production line 14, one or more gas lift header selection valves 64 associated with the gas lift line 16, and one or more test production header selection valves 66 associated with the test production line 18. For example, a first production header selection valve 62 may be disposed in a fluid path between the first retrievable module 42 and the production line 14, and a first gas lift header selection valve 64 may be disposed in a fluid path between the gas lift line 16 and the first retrievable module 42. In some embodiments, each of the one or more production header selection valves 62, the gas lift header selection valve 64, and the one or more test production header selection valves 66 is manifold-resident, such that the valves are permanently disposed in the manifold 12 and are not disposed on, and therefore not removed along with, the retrievable module.

Each header selection valve may be configured to selectively control flow of fluid to the respective module, for example, based on a control signal from the control module 28. Further and as noted, in some embodiments, the header selection valves are resident to the manifold 12 and disposed within a permanent portion of the manifold 12 such that when one or more of the retrievable modules are removed, the valve arrangement 50 remains within the manifold 12.

In some embodiments, a respective test production header selection valve 66 may be included for each other respective header selection valve. For example, embodiments are contemplated in which a total of four production header selection valves 62 are included (one for each retrievable module), four gas lift header selection valves 64 are included (one for each retrievable module), and eight test production header selection valves 66 are included (one for each production header selection valve 62 and gas lift header selection valve 64). However, it should be understood that different numbers of valves may be included to accommodate different numbers of modules. For example, in a manifold system designed for a five-tree well system with five modules, five production header selection valves 62 may be included, five gas lift header selection valves 64 may be included, and ten test production header selection valves 66 may be included.

In some embodiments, the valve arrangement 50 allows the retrievable modules 42, 44, 46, and 48 to be cleaned and removed individually. For example, a cleaning fluid may be routed to a particular retrievable module individually without cleaning the entire manifold 12 or the remaining retrievable modules. In some embodiments, a cleaning fluid may be routed, by way of the valve arrangement 50 and combination of opened/closed valves, from the test production line and to a specific retrievable submodule.

In some embodiments, at least a portion of the valves in the valve arrangement 50 is configured to be remotely actuated. For example, an electrical signal from the control module 28 or in some cases, directly from the FPSO may be used to remotely actuate the valves. Alternatively, in some embodiments, the valves may be hydraulically actuated or actuated using another suitable actuation technique not explicitly described herein. Further, in some embodiments, the valves of the resident valve arrangement 50 may be selected based on a relatively high reliability compared to previous valves disposed in the removable modules. For example, one or more valves with a useful life similar to or exceeding the useful life of the manifold 12 may be used such that the valves do not need to be replaced during the useful life of the manifold 12.

Figure 3:
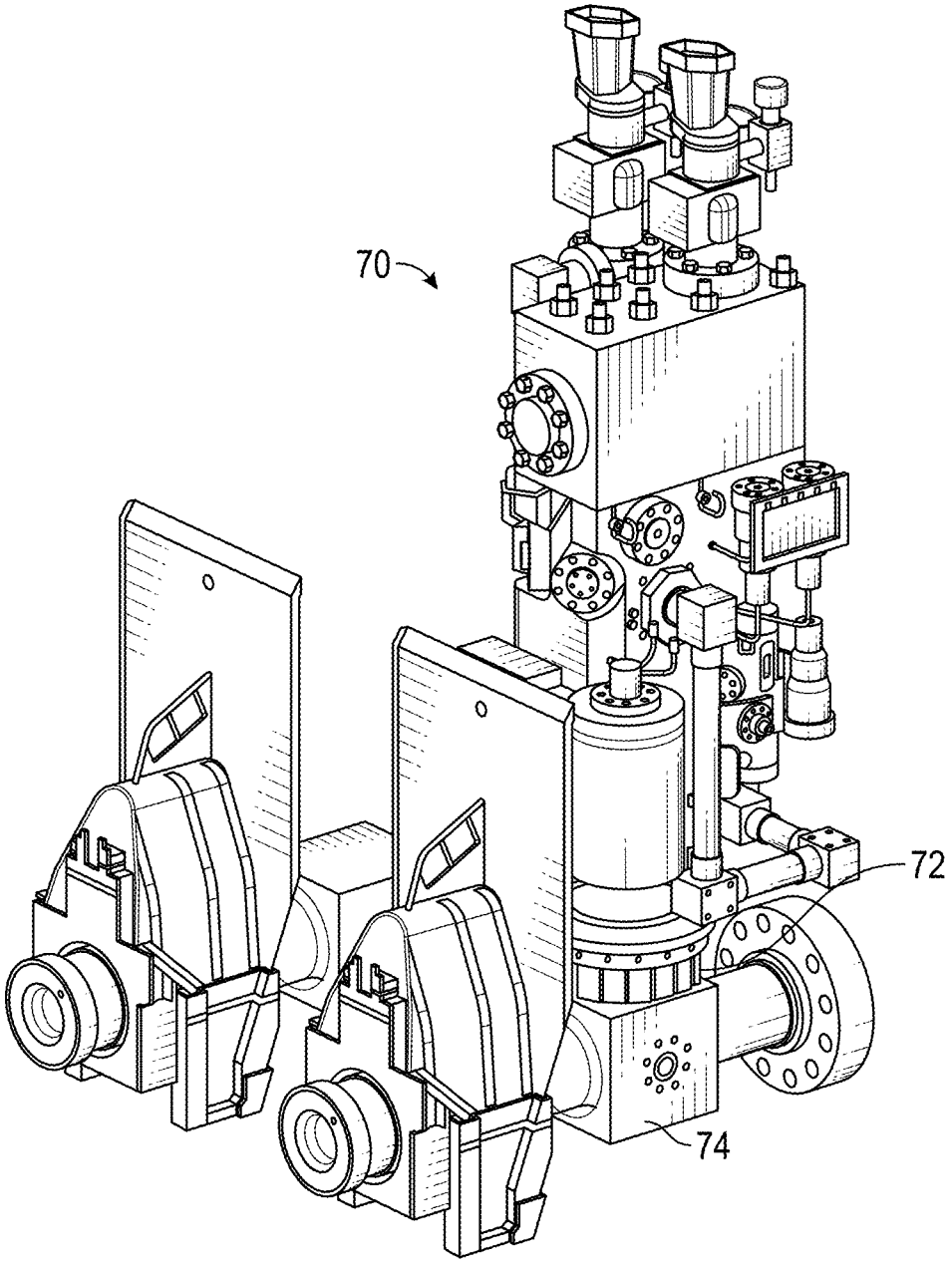
FIG. 3 illustrates an exemplary module structure.

FIG. 3 illustrates an exemplary core structure 70 of the retrievable module 42, 44, 46, 48 relating to some embodiments of the present disclosure. The core structure 70 includes one or more internal components of the exemplary retrievable module, which may be any of the first retrievable module 42, the second retrievable module 44, the third retrievable module 46, or the fourth retrievable module 48. In some embodiments, the retrievable module further comprises a housing or protective covering (not shown) to protect internal components and/or to provide a supporting structure.

The core structure 70 may include a manifold connection 72 to fluidly couple at least a portion of the core structure 70 to a resident manifold portion 74 of the manifold 12. For example, in some embodiments, the manifold connection 72 may include a multi-bore connection having a plurality of distinct flow bores. As such, a single manifold connection 72 may be used to connect to multiple flow lines of the manifold 12.

In some embodiments, the core structure 70 comprises any combination of the components described above disposed therein. For example, the core structure 70 may comprise the one or more flow meters 56, the one or more flow chokes 58, and the chemical injection valves 60 may be included within the core structure 70. In some embodiments, any of the flow meters 56, the flow chokes 58, and the chemical injection valves 60 are disposed internally within the core structure 70 such that they are not visible. Further, the core structure 70 may include a plurality of piping and fluid connections, for example, to route fluid through the retrievable module and to and from the manifold 12 and corresponding tree assembly 26. Further still, in some embodiments, the core structure 70 comprises any number of sensors and additional components not explicitly described herein.

In some embodiments, the retrievable module may be removed by securing a wireline connection to the module and lifting the module up to the surface and onto a vessel.

As an example, the wireline connection or another suitable cable or physical connection may be used to pull the module to the surface. In some embodiments, the connection may be disposed directly onto the core structure 70 or a portion thereof. Alternatively, or additionally, the connection may be made on an external portion of the retrievable module, such as on the housing or protective covering. It should be understood that additional steps may be carried out prior to removing the module. For example, prior to removal, the module may be cleaned and unfastened from the manifold 12 and/or any other connected subsea components.

Figure 4:
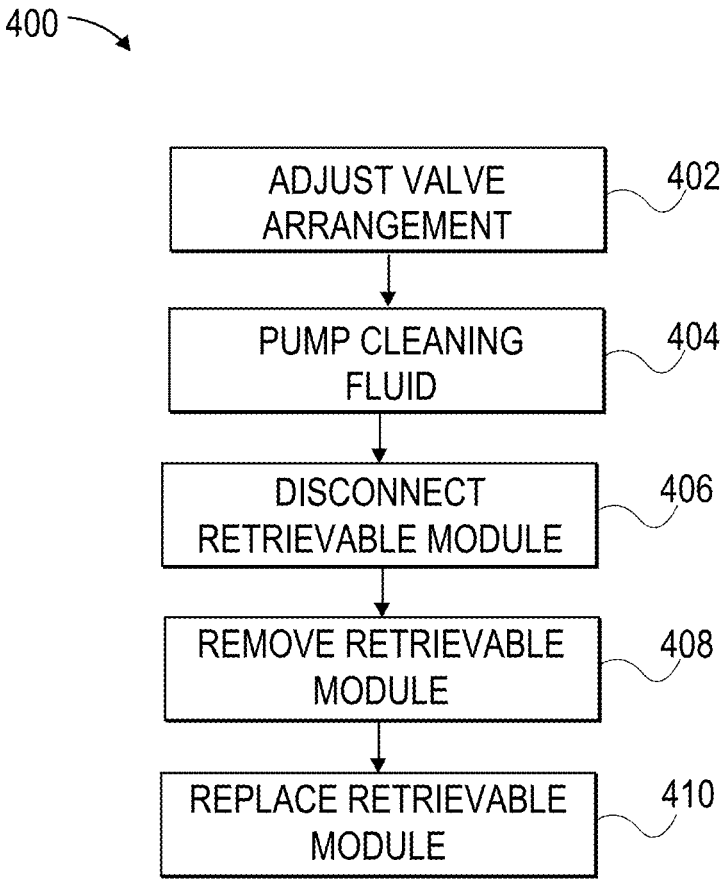
FIG. 4 illustrates an exemplary method of cleaning and replacing a retrievable module.

FIG. 4 illustrates an exemplary method of cleaning and replacing a retrievable module referred to generally herein as reference numeral 400. In some embodiments, the method 400 and portions thereof may be performed routinely to clean, replace, and maintain one or more retrievable modules. For example, the retrievable modules may be replaced according to a predetermined time interval.

At step 402, the valve arrangement 50 is adjusted. In some embodiments, adjustment of the valve arrangement 50 may include opening and/or closing one or more valves of the valve arrangement 50. For example, in some embodiments, prior to a cleaning operation of the retrievable module, a gas lift header selection valve 64 corresponding to the respective retrievable module may be closed and a test production header selection valve 66 may be opened.

At step 404, one or more cleaning fluids are pumped through a header line of the subsea system. In some embodiments, two or more distinct fluids are pumped through the system. For example, the one or more cleaning fluids may include any of a water-based cleaning fluid, an oil-based cleaning fluid, or another suitable cleaning fluid. In some embodiments, an environmentally friendly water-based cleaning fluid is used such that leakage of the cleaning fluid is not detrimental to the environment. In some embodiments, the test production line 18 is used to pump the cleaning fluid. For example, the step of pumping the cleaning fluid may be carried out after closing a respective gas lift header selection valve 64 and opening the corresponding test production header selection valve 66 such that cleaning fluid is routed from the test production line 18 through the retrievable module, to the respective Christmas tree, back through the retrievable module, and through the production line 14 back to the FPSO. A similar cleaning fluid path and valve configuration may be used to clean each respective retrievable module prior to removal and replacement.

At step 406, the retrievable module is disconnected from the manifold 12. In some embodiments, one or more fasteners or fastening mechanisms coupling the retrievable module to the manifold 12 are removed. In some embodiments, a plurality of valves of the manifold may be closed prior to removal of the retrievable module. For example, one or more valves of the valve arrangement 50 corresponding to the respective retrievable module are closed to prevent leaking of production fluid or other fluid within the lines.

At step 408, the retrievable module is removed from the manifold 12. In some embodiments, the retrievable module may be removed by securing one or more wireline connections to the retrievable module. For example, a plurality of wirelines may be secured to the retrievable module and the retrievable module may be removed by lifting the plurality of wirelines using a vessel at surface elevation.

At step 410, the retrievable module is replaced with a new retrievable module. For example, in some embodiments, the retrievable module, such as, any of retrievable modules 42, 44, 46, and 48 have a relatively shorter operating life compared to the manifold 12. For example, the manifold 12 may have a useful life of about 25 years while the useful life of the retrievable module may be a fraction of that. As an example, the retrievable module from a particular slot in the manifold 12 may be removed two or more times during the life of the manifold 12. However, it should be understood that the useful life and period of replacement of the retrievable module and manifold may vary significantly depending on the frequency and environment of operation, as well as based on a plurality of other factors.

The following embodiments represent exemplary embodiments of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting.

Clause 1. A resident valve arrangement disposed in a subsea manifold, the resident valve arrangement comprising: a plurality of production header selection valves fluidly coupled to a production line of the subsea manifold, each production header selection valve of the plurality of production header selection valves corresponding to a respective retrievable module of a plurality of retrievable modules removably coupled to the subsea manifold; a plurality of gas lift header selection valves fluidly coupled to a gas lift line of the subsea manifold, each gas lift header selection valve corresponding to a respective retrievable module of the plurality of retrievable modules removably coupled to the subsea manifold; and a plurality of test production header selection valves fluidly coupled to a test production line of the subsea manifold, each test production header selection valve of the plurality of test production header selection valves corresponding to a respective production header selection valve of the plurality of production header selection valves or a respective gas lift header selection valve of the plurality of gas lift header selection valves.

Clause 2. The resident valve arrangement of clause 1, wherein the resident valve arrangement is disposed in a permanent portion of the subsea manifold.

Clause 3. The resident valve arrangement of clauses 1 or 2, wherein the resident valve arrangement is disposed in a permanent portion of the subsea manifold between the production line and the test production line.

Clause 4. The resident valve arrangement of any of clauses 1-3, wherein the resident valve arrangement is configured to individually route a cleaning fluid to a respective retrievable module of the plurality of retrievable modules.

Clause 5. The resident valve arrangement of any of clauses 1-4, wherein the plurality of production header selection valves, the plurality of gas lift header selection valves, and the plurality of test production header selection valves are remotely actuated.

Clause 6. The resident valve arrangement of any of clauses 1-5, wherein at least a portion of the plurality of production header selection valves, a portion of the plurality of gas lift header selection valves, and a portion of the plurality of test production header selection valves are closed prior to removal of a respective retrievable module.

Clause 7. The resident valve arrangement of any of clauses 1-6, wherein each header selection valve of the plurality of production header selection valves, the plurality of gas lift header selection valves, and the plurality of test production header selection valves is fluidly coupled to a respective bore of a multi-bore connection between the subsea manifold and respective retrievable module of the plurality of retrievable modules.

Clause 8. A subsea system comprising: a subsea manifold comprising: a production header line; a gas lift header line; a test production header line; and a resident valve arrangement disposed in a permanent portion of the subsea manifold, the resident valve arrangement comprising a plurality of header selection valves; and a plurality of retrievable modules removably disposed in the subsea manifold, each retrievable module of the plurality of retrievable modules comprising: one or more flow meters; one or more flow chokes; and a plurality of fluid connections to a respective plurality of flow lines of the subsea manifold, the plurality of fluid connections fluidly coupled to a respective plurality of header selection valves that are resident to a permanent portion of the subsea manifold.

Clause 9. The subsea system of clause 8, further comprising: a pigging module coupled to the subsea manifold, the pigging module comprising: a gas lift connection fluidly connected to the gas lift header line; a test production connection fluidly connected to the test production header line; and a production connection fluidly connected to the production header line.

Clause 10. The subsea system of clauses 8 or 9, wherein the pigging module is retrievable such that the pigging module is removably coupled to the subsea manifold.

Clause 11. The subsea system of any of clauses 8-10, wherein each of the production header line, the gas lift header line, and the test production header line are configured to receive a pigging device and route the pigging device through the pigging module.

Clause 12. The subsea system of any of clauses 8-11, further comprising:

a control module coupled to the subsea manifold.

Clause 13. The subsea system of any of clauses 8-12, further comprising: a plurality of umbilical lines coupled to the control module; and a plurality of separate supporting structures that are physically separate from the subsea manifold, the plurality of separate supporting structures configured to receive umbilical terminations of the plurality of umbilical lines.

Clause 14. The subsea system of any of clauses 8-13, wherein the test production header line is configured to receive a cleaning fluid therethrough.

Clause 15. The subsea system of any of clauses 8-14, wherein each retrievable module of the plurality of retrievable modules is coupled to a respective subsea tree assembly.

Clause 16. A retrievable module for a subsea manifold, the retrievable module comprising: a production line fluid connection fluidly coupled to a manifold-resident production header selection valve of the subsea manifold associated with a production line of the subsea manifold; a gas lift line fluid connection fluidly coupled to a manifold-resident gas lift header selection valve of the subsea manifold associated with a gas lift line of the subsea manifold; a production flow meter operable to measure a flow rate associated with the production line; a gas lift flow meter operable to measure a flow rate associated with the gas lift line; a production flow choke associated with the production line; and a gas lift flow choke associated with the gas lift flow choke, wherein the retrievable module is removably coupled to the subsea manifold.

Clause 17. The retrievable module of clause 16, further comprising: a protective cover disposed over one or more core components of the retrievable module.

Clause 18. The retrievable module of clauses 16 or 17, further comprising: one or more wireline connection points disposed on the protective cover, the one or more wireline connection points configured to receive wireline terminations for lifting and removing the retrievable module from the subsea manifold.

Clause 19. The retrievable module of any of clauses 16-18, wherein each of the production line fluid connection and the gas lift line fluid connection are configured to receive a cleaning fluid prior to removal of the retrievable module.

Clause 20. The retrievable module of any of clauses 16-19, further comprising: one or more chemical injection valves fluidly coupled to the gas lift line fluid connection.

Clause 21. A method of cleaning and replacing a retrievable module of a subsea manifold, the method comprising: adjusting one or more manifold-resident valves of a valve arrangement permanently disposed in the manifold; pumping a cleaning fluid from a test production line of the subsea manifold into the retrievable module via the valve arrangement, wherein the retrievable module is cleaned induvial such that one or more other retrievable modules are not cleaned; disconnecting the retrievable module from the subsea manifold; removing the retrievable module from the subsea manifold; and replacing the retrievable module with a new retrievable module.

Clause 22. The method of clause 21, wherein, prior to a cleaning operation, a gas lift header selection valve of a plurality of gas lift header selection valves is closed and a test production header selection valve of a plurality of test production header selection valves is opened such that the cleaning fluid is routed from the test production line to the retrievable module.

Although the present disclosure has been described with reference to the embodiments illustrated in the attached drawing figures, it is noted that equivalents may be employed, and substitutions made herein without departing from the scope of the present disclosure as recited in the claims.

Having thus described various embodiments of the present disclosure, what is claimed as new and desired to be protected by Letters Patent includes the following:

1. A subsea system comprising:

a subsea manifold comprising:

a production header line;

a gas lift header line;

a test production header line; and a resident valve arrangement disposed in a permanent portion of the subsea manifold, the resident valve arrangement comprising a plurality of header selection valves; and a plurality of retrievable modules removably disposed in the subsea manifold, each retrievable module of the plurality of retrievable modules comprising:

one or more flow meters;

one or more flow chokes; and a plurality of fluid connections to a respective plurality of flow lines of the subsea manifold, the plurality of fluid connections fluidly coupled to a respective plurality of header selection valves that are resident to the permanent portion of the subsea manifold.

2. The subsea system of claim 1, further comprising:

a pigging module coupled to the subsea manifold, the pigging module comprising:

a gas lift connection fluidly connected to the gas lift header line;

a test production connection fluidly connected to the test production header line; and a production connection fluidly connected to the production header line.

3. The subsea system of claim 2, wherein the pigging module is retrievable such that the pigging module is removably coupled to the subsea manifold.

4. The subsea system of claim 3, wherein each of the production header line, the gas lift header line, and the test production header line are configured to receive a pigging device and route the pigging device through the pigging module.

5. The subsea system of claim 1, further comprising:

a control module coupled to the subsea manifold.

6. The subsea system of claim 5, further comprising:

a plurality of umbilical lines coupled to the control module; and a plurality of separate supporting structures that are physically separate from the subsea manifold, the plurality of separate supporting structures configured to receive umbilical terminations of the plurality of umbilical lines.

7. The subsea system of claim 1, wherein the test production header line is configured to receive a cleaning fluid therethrough.

8. The subsea system of claim 1, wherein each retrievable module of the plurality of retrievable modules is coupled to a respective subsea tree assembly.

9. A retrievable module for a subsea manifold, the retrievable module comprising:

a production line fluid connection fluidly coupled to a manifold-resident production header selection valve of the subsea manifold associated with a production line of the subsea manifold;

a gas lift line fluid connection fluidly coupled to a manifold-resident gas lift header selection valve of the subsea manifold associated with a gas lift line of the subsea manifold;

a production flow meter operable to measure a flow rate associated with the production line;

a gas lift flow meter operable to measure a flow rate associated with the gas lift line;

a production flow choke associated with the production line; and a gas lift flow choke associated with the gas lift flow choke, wherein the retrievable module is removably coupled to the subsea manifold.

10. The retrievable module of claim 9, further comprising:

a protective cover disposed over one or more core components of the retrievable module.

11. The retrievable module of claim 10, further comprising:

one or more wireline connection points disposed on the protective cover, the one or more wireline connection points configured to receive wireline terminations for lifting and removing the retrievable module from the subsea manifold.

12. The retrievable module of claim 9, wherein each of the production line fluid connection and the gas lift line fluid connection are configured to receive a cleaning fluid prior to removal of the retrievable module.

13. The retrievable module of claim 9, further comprising:

one or more chemical injection valves fluidly coupled to the gas lift line fluid connection.

* * * * *